US007896685B2

(12) United States Patent
Eppe et al.

(10) Patent No.: US 7,896,685 B2
(45) Date of Patent: Mar. 1, 2011

(54) INSTALLATION SWITCHING DEVICE

(75) Inventors: Klaus-Peter Eppe, Waldbrunn (DE); Carola Thielen, Birkenau-Loehrbach (DE); Albert Stieger, Plankstadt (DE); Richard Hack, Nussloch (DE)

(73) Assignee: ABB AG, Mannheim (DE)

( * ) Notice: Subject to any disclaimer, the term of this patent is extended or adjusted under 35 U.S.C. 154(b) by 31 days.

(21) Appl. No.: 12/444,548

(22) PCT Filed: Oct. 4, 2007

(86) PCT No.: PCT/EP2007/008585

§ 371 (c)(1),
(2), (4) Date: Apr. 6, 2009

(87) PCT Pub. No.: WO2008/043466

PCT Pub. Date: Apr. 17, 2008

(65) Prior Publication Data

US 2010/0081316 A1 Apr. 1, 2010

(30) Foreign Application Priority Data

| | | |
|---|---|---|
| Oct. 6, 2006 | (DE) | 10 2006 047 254 |
| Sep. 13, 2007 | (DE) | 10 2007 043 801 |
| Sep. 14, 2007 | (DE) | 10 2007 044 069 |
| Sep. 17, 2007 | (DE) | 10 2007 044 262 |

(51) Int. Cl.
*H01R 11/20* (2006.01)

(52) U.S. Cl. ..... 439/441

(58) Field of Classification Search ..... 439/441, 439/828, 834, 212, 213, 135, 142
See application file for complete search history.

(56) References Cited

U.S. PATENT DOCUMENTS

| | | | | |
|---|---|---|---|---|
| 3,945,711 | A * | 3/1976 | Hohorst et al. | 439/723 |
| 6,132,238 | A * | 10/2000 | Hartmann et al. | 439/439 |
| 6,875,062 | B2 * | 4/2005 | Bouley et al. | 439/834 |
| 7,101,231 | B2 * | 9/2006 | Prokup et al. | 439/709 |
| 7,150,646 | B2 * | 12/2006 | Trumper | 439/441 |

(Continued)

FOREIGN PATENT DOCUMENTS

DE 1575118 4/1970

(Continued)

OTHER PUBLICATIONS

International Search Report for International No. PCT/EP2007/008585 mailed Jun. 19, 2008.

(Continued)

*Primary Examiner* — Jean F Duverne
(74) *Attorney, Agent, or Firm* — Leydig, Voit & Mayer, Ltd.

(57) ABSTRACT

An installation switching device comprises a housing having a front and a rear face, a mounting side, at least one front and rear narrow side, two wide sides and having an opening at least on the rear face. The installation switching device further comprises a screwless terminal connection including a clamping spring disposed in a terminal connection space and configured to connect a plurality of connecting conductors and a terminal cover part swivelably connected to the housing and configured to cover the opening, the terminal cover part having a terminal face with a plurality of terminal openings, each corresponding to one of the plurality of connecting conductors to be connected and a guide device molded onto each of the at least one terminal openings and configured to guide the connecting conductors.

15 Claims, 7 Drawing Sheets

U.S. PATENT DOCUMENTS

| | | | | |
|---|---|---|---|---|
| 7,384,319 | B2 * | 6/2008 | Kirstein et al. | 439/839 |
| 7,491,098 | B1 * | 2/2009 | Pijoan-Parellada et al. | 439/786 |
| 2005/0245143 | A1 | 11/2005 | Eppe et al. | |

FOREIGN PATENT DOCUMENTS

| | | |
|---|---|---|
| DE | 19654611 | 6/1998 |
| DE | 20206763 | 10/2002 |
| DE | 20312861 | 4/2003 |
| DE | 102004008447 | 9/2005 |
| DE | 102004062850 | 6/2006 |
| EP | 1089379 | 4/2001 |
| EP | 1124286 | 8/2001 |
| EP | 1128471 | 8/2001 |
| EP | 1432077 | 6/2004 |
| EP | 1575130 | 9/2005 |
| EP | 1641079 | 3/2006 |
| EP | 1672741 | 6/2006 |
| EP | 1675218 | 6/2006 |
| JP | 10074543 | 3/1998 |
| JP | 2000306618 | 11/2000 |
| JP | 200251970 | 9/2003 |

OTHER PUBLICATIONS

German Search Report, Application No. DE 10 2007 044 262, mailing date Dec. 6, 2007.

* cited by examiner

INSTALLATION SWITCHING DEVICE

This is a U.S. National Phase application under 35 U.S.C. §371 of International Application No. PCT/EP2007/008585, filed on Oct. 4, 2007, which claims priority to German Applications No. DE 10 2006 047 254.3, filed on Oct. 6, 2006; DE 10 2007 043 801.1, filed on Sep. 13, 2007; DE 10 2007 044 069.5, filed on Sep. 14, 2007; and DE 10 2007 044 262.0, filed on Sep. 17, 2007. The International Application was published in German on Apr. 17, 2008 as WO 2008/043466.

The invention relates to an installation switching device comprising a housing and with a screwless terminal connection with a clamping spring for the connection of connecting conductors.

BACKGROUND

A generic installation switching device can be, for example, a circuit breaker, a fault-current circuit breaker, a motor protection switch or the like. It comprises within its housing at least one contact point comprising at least one fixed and one moving contact member via which a current path leading from an input terminal to an output terminal can be opened and closed. The contact point is generally actuated by a switching mechanism with latching point. A generic installation switching device can also comprise tripping devices, for example a thermal trip or an instantaneous tripping magnet which, when a short circuit or fault current occurs in the current path, act on the contact point or the switching mechanism, respectively, so that the contact point is opened.

Apart from screw terminals, screwless clamping connections are also used for the connection to external connecting conductors in generic installation switching devices. In this context, plug-in terminals or spring-pull terminals can be used as clamping elements. In principle, these can considerably simplify the connection of connecting conductors but known installation switching devices with screwless terminal connections are still subject to considerable restrictions in use today.

From EP 1 432 077, a generic installation switching device with a screwless terminal connection is known in which the terminal connection space is open towards the narrow side of the housing and is covered with a cover part corresponding to the housing width in its width. The cover part is clipped to the housing on its narrow side. At the terminal connection according to EP 1 432 077, rigid conductors can be inserted without tools but the insertion of flexible conductors and the removal of the conductors from the terminal connection require the use of a tool.

From EP 1 089 379, a generic installation switching device comprising a clamping spring housing moulded separately onto the housing is known in which the conductors can be inserted and extracted without use of a tool. Due to the clamping spring housing being moulded on separately, the construction is very elaborate however and is additionally restricted to the use of spring-pull terminals.

EP 1 124 286 shows a generic installation switching device with plug-in terminals which, however, are accommodated on a separate terminal block, wherein the terminal block must be subsequently plugged onto the switching device. In this respect, the solution demonstrated here is very elaborate and requires additional parts for plugging on to the installation switching device so that no standardized uniform housings can be used.

SUMMARY OF THE INVENTION

An aspect of the present invention is to provide a generic installation switching device in which the terminal connection is arranged in a simple and cost-effective manner in such a manner that the toolless insertion and removal of connecting lines becomes possible.

According to the invention, the terminal connection space is laterally limited by the wide housing sides and is open at least to the front face, wherein the opening of the terminal connection space can be covered by a terminal cover part which is swivelably connected with the housing. The terminal cover part has a terminal face with a number of terminal openings corresponding to the number of connecting conductors to be connected and guide means, moulded onto each terminal opening, for the connecting conductors.

According to an advantageous embodiment, spring actuating means are moulded onto the cover part and are arranged in such a manner that, when the cover part is swivelled against the clamping spring, they load the latter so as to open it.

The terminal connection of an installation switching device according to the invention comprises very few components, namely the clamping spring, a conductor bar with a clamping edge against which the clamping spring clamps the connecting conductor to be connected, and the cover part. It can, therefore, be produced in a very simple and cost effective manner.

The cover part is arranged in such a manner that it realizes a number of functions in one component:

- The guide means moulded onto the cover part at each terminal opening provide for the guidance of the connecting conductor towards the connecting terminal at the required insertion angle. Neither the conductor bar nor the clamping spring itself need to exhibit further guide means for guiding the connecting conductor.
- A number of connecting conductors are inserted through a number of terminal openings and are held apart at the same time. Thus, an individual insertion of each individual conductor end is possible even with a number of conductor ends to be clamped on, without further measures for keeping the individual conductors apart being required at the clamping spring or the conductor bar.
- Due to the spring actuating means moulded onto the cover part according to another advantageous embodiment, the cover part can become the opening tool for the clamping spring at the same time. A separate actuating tool, for example a screwdriver, for opening the clamping spring is no longer required. This greatly simplifies the insertion and removal of connecting conductors.

According to an advantageous embodiment of the invention, the terminal cover part is resiliently loaded by the clamping spring in opposition to the direction of insertion of the external connecting conductor, and can be pressed against the clamping spring. In this arrangement, the cover part can be particularly advantageously resiliently loaded by the clamping spring against a projection, used as stop, of the housing wall. The terminal cover part is thus held in a defined initial position due to the resilient loading of the clamping spring. The initial position is in this case the closing position of the clamping spring.

According to a particularly advantageous embodiment of the invention, the spring actuating means are formed by the guide means, moulded onto each terminal opening, for the connecting conductors. This can be implemented, for example, by the guide means for the connecting conductors being tube-like hollow bodies pointing from the inside of the cover part to the clamping spring and forming a lead-in conduit for the connecting conductors. The terminal cover part can then be constructed in a particularly simple manner and can be produced, for example, as cost-effective injection moulding part.

For the pressure actuation of the terminal cover part, it can be provided that the terminal cover part has a pressure area which is accessible from the outside and can be manually operated.

To ensure access for a voltage tester to the terminal connection in a simple manner in the operating state, that is to say after completed assembly of the installation switching device, the terminal cover part can have a test opening for electrically contacting the terminal connection.

With respect to the spatial arrangement of the terminal face with respect to the front face of the housing and of the guide means with respect to the terminal face, a possible embodiment of the invention provides that the terminal face of the terminal cover part extends approximately in parallel with the rear face and the guide means are inclined with respect to the terminal face of the terminal cover part. The angle of inclination for the guide means must be selected in accordance with the principle that the connecting conductors remain easily accessible during the series installation of an installation switching device according to the invention, for example in a distribution box, and connecting conductors are not bent away towards the top too much.

In this respect, a further advantageous embodiment provides that the terminal face of the terminal cover part is inclined with respect to the rear face and the guidance conduits extend approximately perpendicularly to the terminal face. In this embodiment, the angle of inclination at which the connecting conductors are inserted relative to the spring terminal is determined by the angle of inclination of the guidance conduits.

Naturally, a combination of the two possibilities demonstrated above would also be conceivable in which both the terminal face of the terminal cover part is inclined with respect to the rear face and the guidance conduits are inclined with respect to the terminal face.

To additionally provide for the actuation of the spring terminal by an external tool on demand, for example for reasons of redundancy, according to a further embodiment of the installation switching device according to the invention the terminal cover part can have an access opening for an actuating tool. It is then possible to bring the clamping spring into its opening position through this access opening by means of the actuating tool, for example a screwdriver.

According to an advantageous embodiment, a closing part is coupled swivelably with the free end, pointing towards the front face, of a first part-body of the terminal cover part, which covers the terminal connection space at the front face in collaboration with a housing-fixed front face end, the closing part at least partially overlapping the housing-fixed front face end on actuation of the terminal cover part.

The closing part and the housing-fixed part of the front face together form the front face. Supplementing the housing-fixed part, the closing part thus acts as part of the front face at the terminal cover part side.

According to a particularly advantageous embodiment, the closing part is constructed to be plate-shaped. It can be advantageously produced in the same injection moulding process as the terminal cover part.

An embodiment in which the closing part is coupled to the terminal cover part by means of a hinge, for example a film hinge, is particularly very advantageous. Such a film hinge can be produced very advantageously by injection moulding.

A further, very advantageous embodiment of the invention is characterized by the fact that the closing part is guided displaceably in a housing-fixed rocker-like guide in parallel with the front face via laterally protruding guide pins. The closing part is then carried overlapping the part at the housing side of the front face in a displaceable manner As a result, it can be swivelled behind the part at the housing side of the rear part, and displaced, on actuation of the terminal cover part. This ensures tight covering of the terminal receiving space towards the front face with simultaneous mobility of the terminal cover part and mechanical stability of the rear face.

By attaching the hinge to the closing part, the latter can move in a space-saving manner in parallel with the front face in a rocker-like guide.

A development of the invention which is also very advantageous is characterized by the fact that the terminal cover part carries, following the terminal face, a spacing area which forms the closure at the terminal cover part side of the terminal receiving space in the area of the narrow side, wherein the closing part is coupled swivelably at the end of the spacing area pointing towards the front face. As a result, it is possible to place the terminal face into a part of the narrow side wall of the switching device which is closer to the mounting side if this is required due to a predetermined arrangement of the connecting terminals in the interior of the switching device close to the mounting side.

According to a particularly advantageous development of this embodiment, the spacing area is constructed to be rigid. This provides for a transmission of force to the spring of the connecting terminal also by actuation of the terminal cover part over the spacing area. This is advantageous if the pressure area of the terminal cover part, due to the position of the connecting terminal, is now only accessible with difficulty by an operating person due to the position of the connecting terminal very close to the mounting side of the switching device in the installed position of the switching device, for example in an installation distributor. In an area which is not covered by a connecting conductor, the spacing area can thus be used as second pressure area for actuating the spring.

In a particularly advantageous further embodiment of the invention, the spacing area carries an access opening for an actuating tool. The connecting terminal can thus be operated either manually in or also by means of a tool via the terminal cover part.

According to a further, very advantageous embodiment of the invention, the closing part consists, at least in the area of the coupling with the first part-body, of a material which has different mechanical properties than the first part-body of the terminal cover part.

Here, too, the closing part covers the terminal connection space at the front face in collaboration with a housing-fixed front face end, the closing part at least partially overlapping the housing-fixed front face end on actuation of the terminal cover part.

The closing part and the housing-fixed part of the front face thus together form the front face. As a supplement to the housing-fixed part, the closing part thus acts as part at the terminal cover part side of the front face.

In this arrangement, an embodiment is particularly advantageous in which the hinge and the closing part consist in the area of the hinge of a material which has different mechanical properties than the first part-body of the terminal cover part.

Due to the fact that the closing part consists, at least in the area of the coupling with the first part-body of the terminal cover part, of a material having other mechanical properties than the latter, the spring-elastic characteristics of the closing part and its coupling with the first part-body can be specified independently of those of the first part-body of the terminal cover part and optimized for the application. This is of advantage especially if different, in some cases even opposite mechanical demands are made on the first part-body of the terminal cover part than on the closing part.

This can be the case if the terminal cover part, with an actuation, that is to say a swivelling into the interior of the switching device, simultaneously actuates the clamping spring in a manner so as to open it in opposition to its restoring spring force.

This can be effected, for example, by spring actuating means moulded onto the terminal cover part in a suitable position, which act on the clamping spring during a swivelling of the terminal cover part.

In this case, the first part-body of the terminal cover part must have a high stiffness so that the force for opening the clamping spring can be transferred without deformation of the terminal cover part.

However, the closing part should be flexible, but at least coupled flexibly to the first part-body of the terminal cover part so that it can slide in a space-saving manner behind the housing-fixed front face end in the rocker-like guides during the swivelling of the terminal cover part.

When the terminal cover part is swivelled into the device interior, the angle between the closing part and the first part-body of the terminal cover part is forced to change.

This is because the closing part should extend as parallel as possible to the housing-fixed front face end. Yet the angle between the first part-body of the terminal cover part and the housing-fixed front face end changes when the terminal cover part is swivelled. A mobility of the closing part with respect to the first part-body of the terminal cover part, which can only be achieved by a flexibility of the material at this point, is therefore required at the coupling point.

According to a particularly advantageous development of the invention, the spacing area is constructed to be rigid and the closing part is constructed from a soft material, which is softer than the spacing area, at least in the area of the coupling with the spacing area.

This meets the two contradictory requirements for different part-bodies of the terminal cover part. A single component, the terminal cover part, has different material properties in different areas. Due to the stiff part-area, a force can be transmitted to the spring of the connecting terminal also by actuating the terminal cover part over the spacing area. The closing part, the second part-area, however, can be bent away easily and shifted in parallel with the front faces and behind these.

In a particularly advantageous embodiment of the invention, the terminal cover part, with the closing part coupled thereto, is produced in a two-component injection moulding process. In this process, materials having different mechanical properties, that is to say, for example, hard and soft plastics, can be joined during the injection moulding.

With respect to an advantageous embodiment of the terminal connection, an installation switching device according to the invention has a clamping spring acting as compression spring on the conductor end, for clamping the conductor end at an abutment, wherein the terminal connection comprises a conductor bar with a connecting end and an adjoining discharge area. The conductor bar has at the connecting end a window-like opening with a support edge, and a clamping edge opposite the support edge, at the transition of the connecting end into the discharge area. The clamping spring also has a support leg by means of which it is supported at the support edge of the conductor bar. An arc piece adjoins the support leg and is adjoined by a clamping leg so that the conductor end can be clamped tight between the clamping leg and the clamping edge as abutment. The conductor end can be inserted into the window-like opening from the side of the arc piece.

According to an advantageous embodiment of the invention, the arc piece is adjoined by a first part-clamping leg which changes into a second part-clamping leg, bent away from the first part-clamping leg, at a bending edge so that the first and the second part-clamping leg assume an obtuse angle with one another, the opening of which points in the direction of insertion of the connecting conductor.

The obtuse angle between the first and the second part-clamping leg provides the advantage that the point of attack can be placed in the vicinity of the spring actuating means in the vicinity of the bending edges. As a result, the resting point of the spring actuating means can have a greater distance from the point of rotation of the clamping leg at the arc piece without the maximum terminal opening, which can be achieved as a result, becoming smaller and without the spring actuating means being in the way of a connecting conductor having a large cross section. However, a greater distance between the resting point and the point of rotation means a more advantageous lever ratio and thus a lower actuating force for the user.

A preferred embodiment is characterized by the fact that the conductor bar approximately has a U-shape, the connecting end forming the one U-leg and the discharge area being formed by the crossbar and the other U-leg. In this arrangement, an upward bend for attaching further current conductors which lead into the interior of the installation switching device can be provided at the free end of the other U-leg.

According to a further embodiment, a discharge bar can also be mounted onto the free end of the other U-leg. The discharge bar can extend approximately perpendicularly to the other U-leg and the side of the connecting end opposite the clamping edge can be supported at the discharge bar.

A further advantage of an installation switching device according to the invention lies in the fact that the discharge area of the conductor bar can be used for electrical contacting during the calibration of the thermobimetal. In previously known installation switching devices, the contact point for the calibration of the thermobimetal is arranged at another point outside the access area of the terminal connection and is not accessible via the terminal connection. Since the thermobimetal can only be calibrated in the completely assembled state, the separate access openings to the calibration contacts must be covered by additional cover parts after the calibration in known installation switching devices.

This is not necessary in an installation switching device according to the invention. Compared with the installation switching devices known in the prior art, this saves both assembly parts—namely the additional cover parts—and production steps in the assembly so that the resultant simplification of assembly results in a further advantage of the installation switching device according to the invention.

An installation switching device according to the invention can be completely assembled apart from the terminal cover part. The calibration of the thermobimetal is then performed—by means of electrical contacting through the opening of the terminal connection—by using the discharge area of the conductor bar as calibration contact. After completed calibration, the terminal cover part is put in place and the installation switching device is thus completed. A separate cover part for the calibration opening is no longer required.

A further advantage is given by the fact that, due to the arrangement according to the invention, the terminal connection of an installation switching device according to the invention is constructed in such a manner that it only has a low electrical resistance even with very narrow external dimensions. This is achieved by the fact that the conductor bar has a uniform width in the discharge area between the clamping edge and the point at which a further current conductor is attached which leads into the interior of the installation switching device. This makes it possible to build up installation switching devices according to the invention also in half standard module width.

According to DIN 43 880, a module a is defined for the module width of installation switching devices. According to this standard, the module width is an integral or half-integral multiple of 17.5 mm, more precisely: a=n×(17.5 mm+0.5 mm), n=0.5; 1.5; 1.5; 2.0, . . . .

An installation switching device having half a standard module width thus has a module width of 9 mm.

In a further embodiment, the clamping leg of the clamping spring can be longitudinally slotted for facilitating the clamping-on of two connecting conductors, so that two part-springs are produced which are closely next to one another and can be clamped independently of one another. Due to the fact that the two part-springs are close together, that is to say without having a separating, relatively large intermediate space or an intermediate web between them which is approximately in the centre, a further contribution is made towards a narrow construction of the terminal connection so that the terminal connection according to the invention can be installed in an installation switching device having only half a standard module width.

Further advantageous embodiments and improvements of the invention and further advantages can be found in the subclaims.

BRIEF DESCRIPTION OF THE DRAWINGS

The invention and further advantageous embodiments and improvements of the invention will be explained in greater detail and described with reference to the drawings, in which 5 illustrative embodiments of the invention are shown.

In the drawings.

DETAILED DESCRIPTION

In the figures, identical or identically acting components or elements are in each case provided with identical reference numbers even if they are arranged in slightly modified form in different variants of the embodiment.

Figure 1:
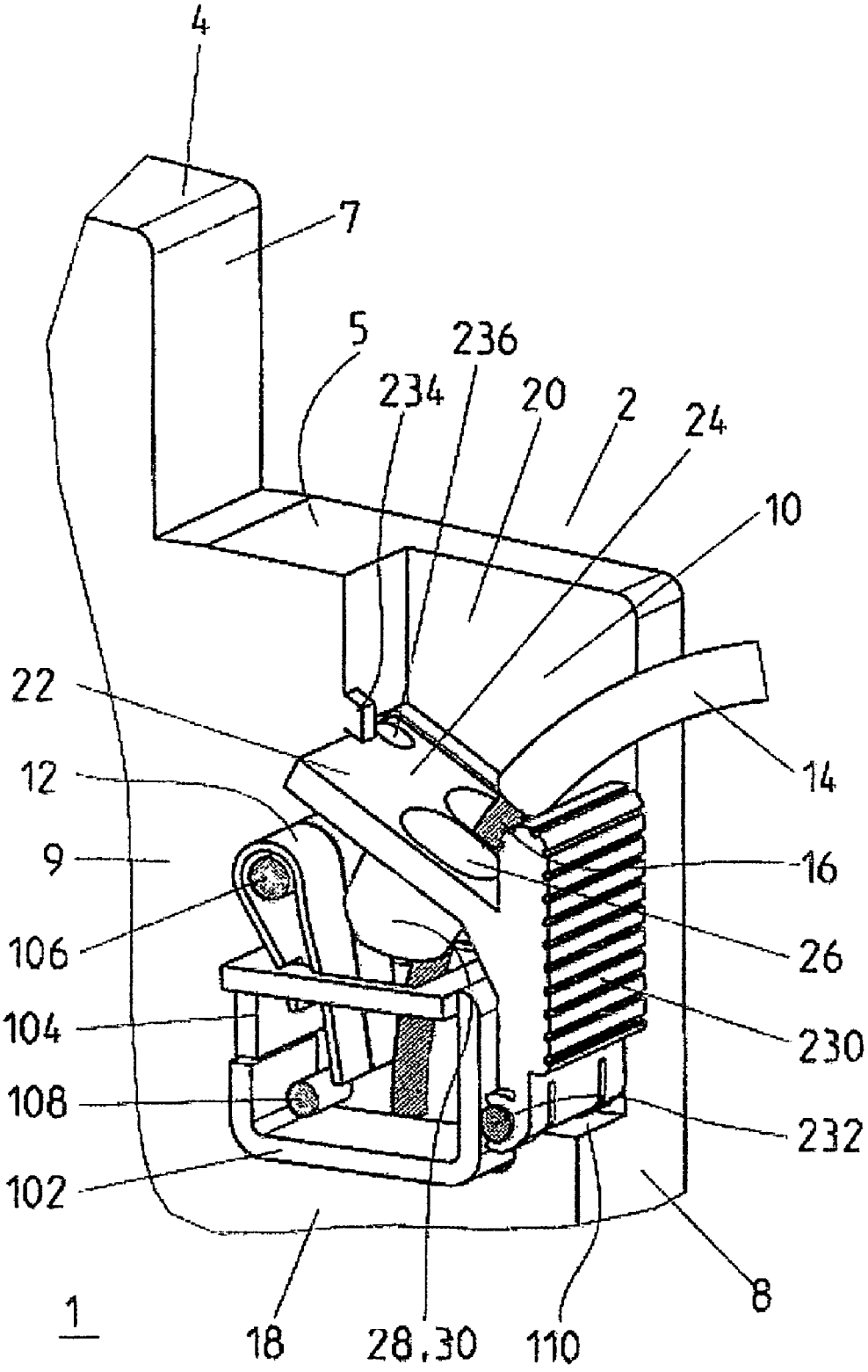
FIG. 1: shows a diagrammatic partial sectional view of an installation switching device according to the invention in a first embodiment.
Figure 2:
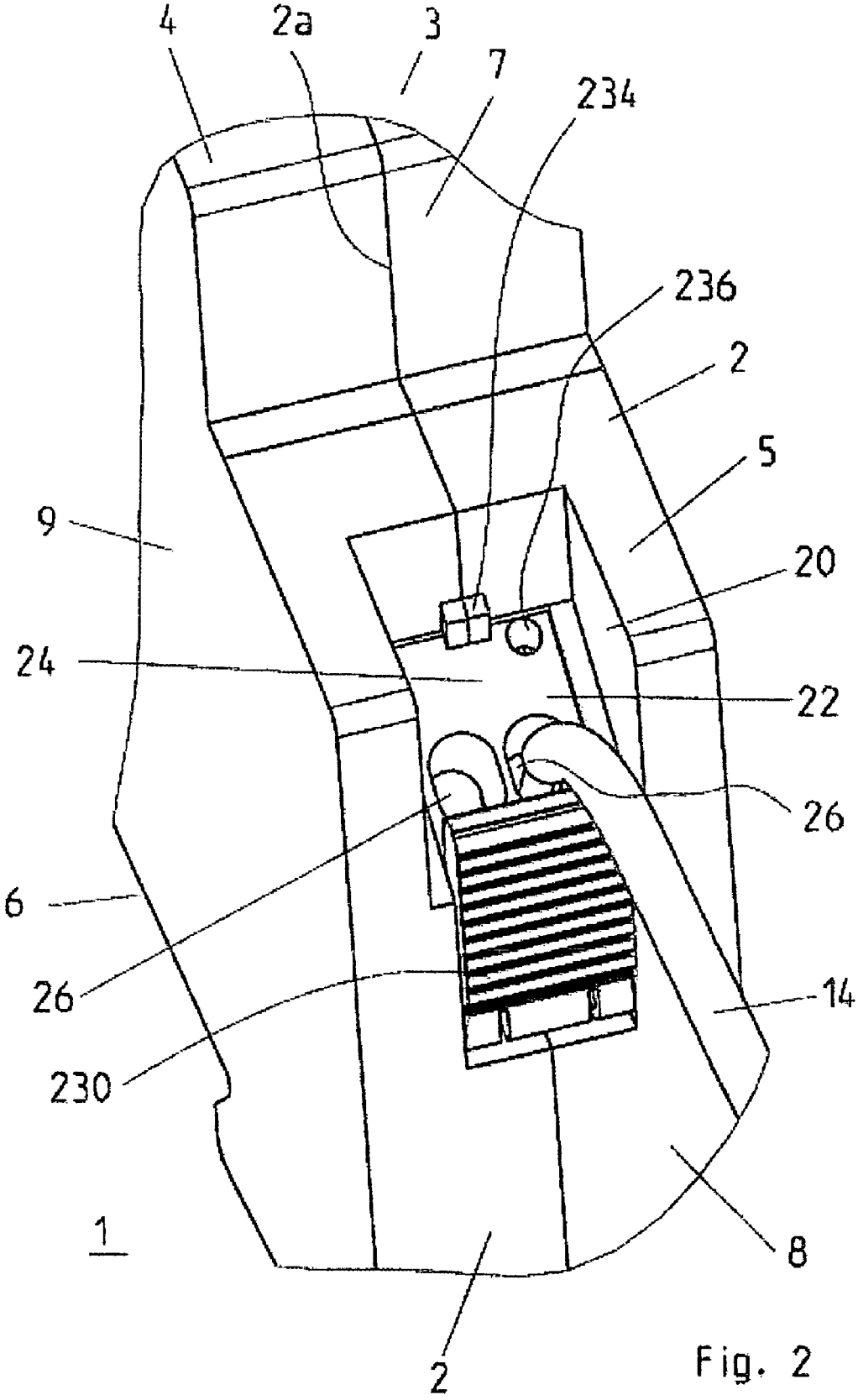
FIG. 2: shows a diagrammatic part-view of the installation switching device according to FIG. 1, FIG. 3*a*: shows a diagrammatic view of the spring force terminal of the installation switching device according to FIG. 1 according to the invention, in the closed state.

Thus, FIG. 1 shows a partial sectional view of the terminal connection space 18 of an installation switching device 1 according to the invention with the housing opened. FIG. 2 shows a corresponding part-view with the housing 3 closed.

The installation switching device 1 has an insulating housing 3 formed from two housing parts 2 joined together along a partition line 2*a*, with a front face 4, a rear face 5, a mounting or connecting side 6, a front narrow side 7, a rear narrow side 8 and two wide sides 9, only one of which is shown in the view according to FIG. 2.

The terminal connection space 18 is limited laterally, that is to say towards the wide side, by the housing wide sides 9 of the insulating housing 3. Towards the front face 4, an opening 20 of the terminal connection space 18 is formed by an opening in the rear face of the housing part 2, through which the terminal connection 10, fixed in position in the terminal connection space 18, is accessible for the connection of connecting conductors 14. Due to a further opening at the rear narrow side 8 of the housing part 2, the opening 20 of the terminal connection space 18 extends past the contact edges between the rear narrow side 8 and the rear face 5 into the rear narrow side 8. This has the advantage that increased flexibility is given for the direction of connection of the connecting conductor 14.

The terminal connection 10 described in the text which follows is a so-called plug-in terminal connection. It comprises a conductor bar 102 and a clamping spring 12. The terminal connection 10 rests on a projection 110 formed on the inside of the wide side 9 and is there fixed in position in the terminal connection space 18 in a manner known per se by means of webs 104 and pins 106, 108. The terminal connection 10 fixed in position in the terminal connection space 18 is thus located between the rear narrow side 8 and the rear face 5 in the area of the contact edge.

Figure 3A:
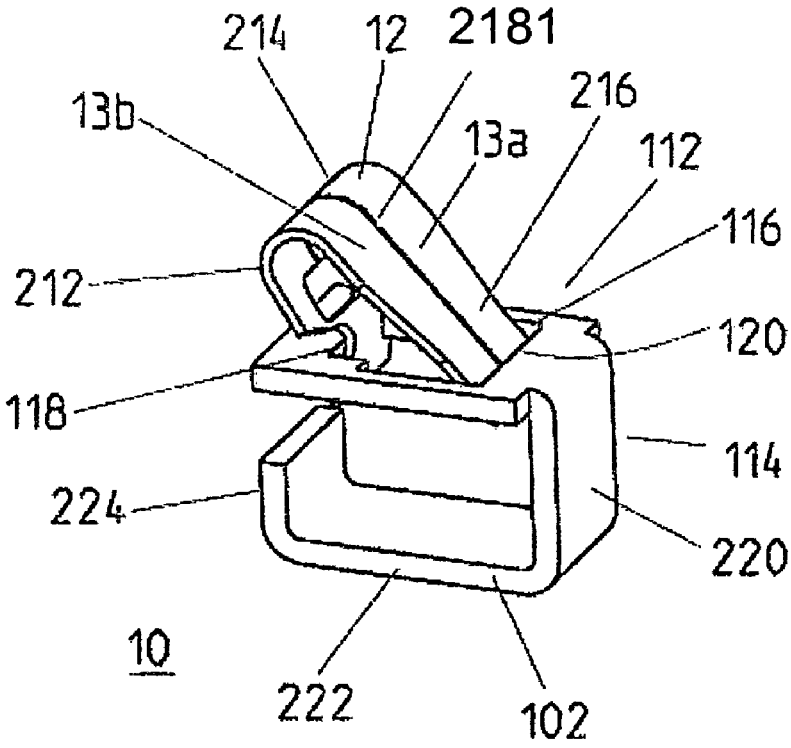
FIG. 3*b*: shows a diagrammatic view of the spring force terminal of the installation switching device according to the invention according to FIG. 1, in the opened state.
Figure 3B:
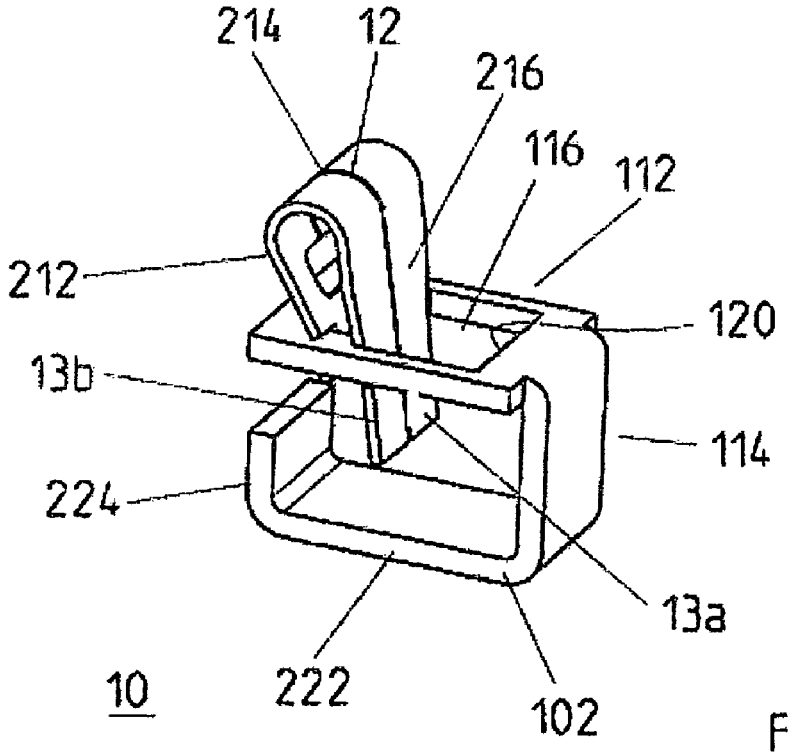

The construction of the terminal connection 10 is shown in detail in FIGS. 3*a* and 3*b*. The conductor bar 102 comprises a connecting end 112 and an adjoining discharge area 114. At the connecting end 112, it has a window-like opening 116 with a support edge 118 and a clamping edge 120 opposite the support edge 118. The clamping edge 120 is located at the transition of the connecting end 112 into the discharge area 114.

The clamping spring 12 has a support leg 212 with which it is supported on the support edge 118 of the conductor bar 102. The support can be effected in such a manner that the support leg 212 has at its free end an upward bend with which it partially encloses the support edge 118 for the purpose of supporting.

The support leg 212 is adjoined by an arc piece 214 which is adjoined by a clamping leg 216. The conductor end 16 of a connecting conductor 14 is inserted into the window-like opening 116 from the side of the arc piece 214 and can be clamped tight between the clamping leg 216 and the clamping edge 120 acting as abutment. In this arrangement, the free end of the clamping leg 216 passes through the window-like opening 116.

The clamping leg 216 of the clamping spring 12 is longitudinally slotted along a slot 2181 so that two part-springs 13*a*, 13*b* are produced which can be clamped independently of one another and by means of which two connecting conductors can be clamped on independently of one another. The slot 2181 is very narrow and does not produce a spatial separation of the two part-springs 13*a*, 13*b*. The only result is that they can be bent independently of one another due to the slot. Otherwise, the two part-springs 13*a*, 13*b* are close together at their narrow longitudinal sides, however, so that no additional space is needed between them.

The conductor bar 102 has an approximately U-shaped basic form, the connecting end 112 forming the first U-leg and the discharge area 114 being formed by a crossbar 220 and the second U-leg 222. At the free end of the second U-leg 222, an upward bend 224 is attached. At this upward bend 224, further connecting conductors can be attached by means of which the terminal connection 10 is connected to other assemblies within the switching device housing such as, for example, the tripping assemblies. In particular, the connecting conductors can be welded or hard-soldered to this upward bend, and screwing-on is also possible.

Figure 6:
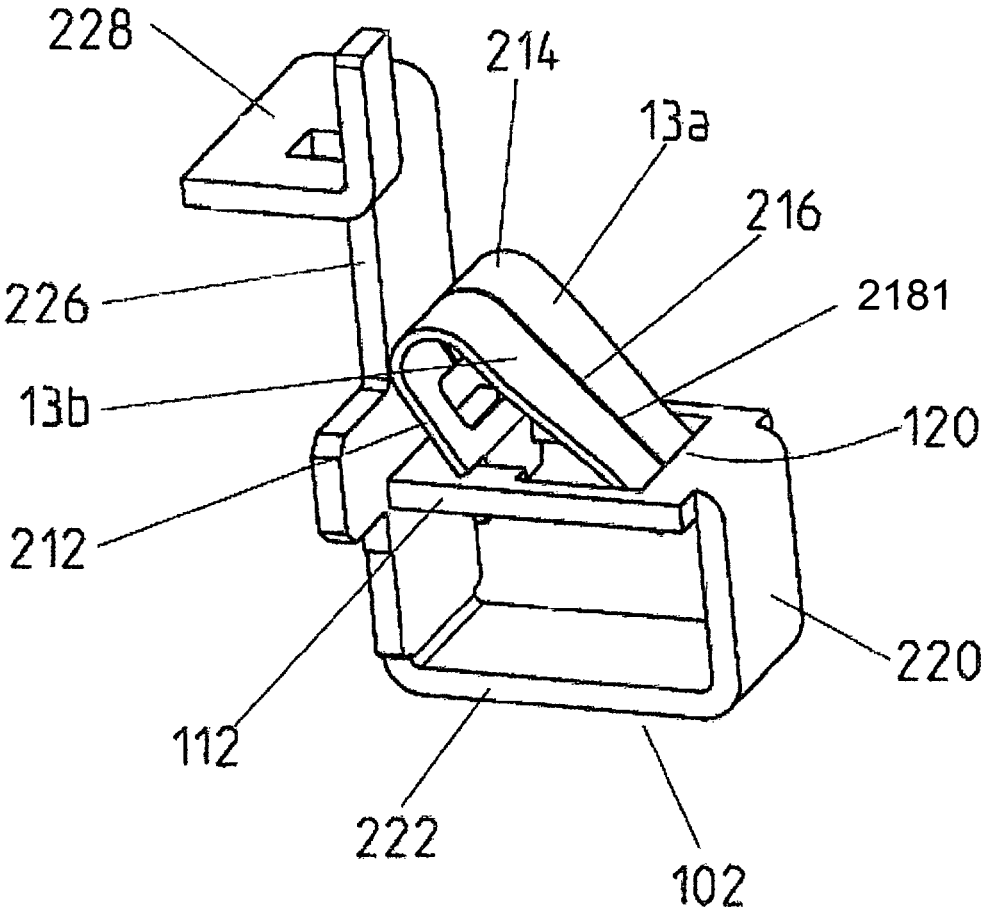
FIG. 6: shows a diagrammatic view of a variation of the spring force terminal according to FIG. 3*a*, FIG. 7: shows a diagrammatic partial sectional view of an installation switching device according to the invention with a terminal cover part at which a closing part is coupled via a hinge, with the closed terminal.

In an alternative embodiment of a terminal connection which is shown in FIG. 6, the upward bend is elongated at the free end of the second U-leg 222 to form a discharge bar 226. The discharge bar 226 is thus positively joined to the second U-leg 222; it points approximately perpendicularly from the latter in the direction of the window-like opening 116 and protrudes above it. At the free end of the discharge bar 226, a further upward bend 228 is located to which further connecting conductors can be welded or riveted again. The upward bend can also, however, be used directly as terminal connection within the switching device. Overall, the conductor bar 102 according to the present embodiment is provided with an external contour which resembles the small letter "b". The connecting end 112 of the conductor bar 102 is supported against the discharge bar 226. From the conductor bar 102 and the discharge bar 226, a closed terminal frame is thus produced which is stable in itself. This increases the mechanical stability of the terminal connection 10.

This is because, as a result, the advantage is produced that the forces acting on the terminal connection 10 during the insertion and detachment of the connecting conductor are absorbed by it as a closed system and thus forces acting on other elements of the installation switching device such as, for example, the housing, are reduced.

The conductor bar 102 can be produced in very large numbers inexpensively and simply and in a wide variety of shapes, for example as punched bent part.

Now back to FIGS. 1 and 2. The opening 20 of the terminal connection space 18 is covered by a terminal cover part 22 swivelably connected with the housing 3. The terminal cover part 22 is constructed to be approximately L-shaped, the two legs being formed by cover plates located at an angle to one another.

The first cover plate covers the terminal connection space 18 towards the rear face 5 and has a terminal face 24, with two terminal openings 26, wherein one connecting conductor 14 can be connected through each of the terminal openings 26.

The second cover plate covers the terminal connection space 18 towards the rear narrow side 8 and has a pressure area 230 which is accessible from the outside and which can be manually operated. At its free edge, the second cover plate has a half-open, tube-like cavity with which it is supported rotatably in a hinge pin 232 connected with the wide side 9 of the housing 3. The terminal cover part 22 can thus be swivelled around the free edge of the second cover plate in the direction of the clamping spring by means of pressure on the pressure area 230. Falling-out of the cover part 22 is prevented by a projection 234 at the housing wall, which is used as a stop. In the example of FIG. 1, one half of the projection 234 is in each case attached to each of the two housing parts 2 at their contact edge.

At the first cover plate of the cover part 22, tube-like hollow bodies 28 forming a lead-in conduit are attached at each of the terminal openings 26, aligned towards the clamping spring 12. These are used at the same time as guide means for the connecting conductor 14 to be inserted and as spring actuating means 30. When the cover part 22 is swivelled in the direction of the clamping spring 12 around the hinge pin 232 by pressure on the pressure area 230, the hollow bodies 28 press the clamping leg 216 in the clamping spring 12 away from the clamping edge 120 of the conductor bar 102 so that space for inserting the stripped connecting conductor end 16 of the connecting conductor 14 is produced between the clamping edge 120 and the clamping leg 216. FIG. 1 shows this condition.

If, after the insertion of the connecting conductor end, the pressure area 230 of the cover part 22 is released again, the clamping leg 216 of the clamping spring 12, due to its spring force, again presses the cover part 22 outwards over the hollow bodies 28 and, at the same time, clamps the end 16 of the connecting conductor 14 against the clamping edge 120 of the window-like opening 116.

In the embodiment according to FIG. 1, two terminal openings 26 exist in the terminal face 24 of the cover part 22, and behind each terminal opening 26 a tubular hollow body 28 is located, moulded onto the terminal face, as guide means for the connecting conductor and as spring actuating means. In this arrangement, each terminal opening 26 and each guide means 28 is allocated to one of the two partial clamping springs 13*a*, 13*b* as have been produced by the slot 2181 in the clamping spring 12. Thus, if two conductors are to be clamped down, a conductor 14 is inserted through each of the two terminal openings 26 and clamped on by in each case one of the partial clamping springs 13*a*, 13*b*. The connecting conductors 14 are separated and guided in the hollow bodies 28 used as guide means for the connecting conductors 14 and thus no separate guiding or separating devices are required at the terminal connection 10. In particular, it is not required to subdivide the opening 116 into two receiving spaces by means of a web. Neither is it required to separate the two partial clamping springs 13*a*, 13*b* by means of a great distance between the two. They can be located close to one another with their narrow longitudinal side.

The terminal connection 10 can thus be constructed in a very simple and narrow manner so that it can be installed in an installation switching device of half a module width.

It can be seen that, overall, only three components are required: the conductor bar 102, the clamping spring 12 and the cover part 22. This greatly simplifies the assembly.

Due to the spring force of the clamping spring 12, the cover part 22 is pressed outwards against the projection 234 in the state of rest so that the cover part always assumes a defined position in the state of rest.

The cover part thus fulfils two functions: on the one hand, the functions of guidance of the connecting conductors and, on the other hand, the function of the spring actuating tool. Both rigid and flexible conductor ends can be clamped in and also removed again from the terminal by means of the device according to the invention, without an external actuating tool for the clamping spring.

Naturally, there could also be an additional slot in the terminal face 24 of the cover part 22 through which an external tool could then be pushed for operating the clamping spring 12.

Furthermore, a test opening 236 is arranged in the terminal face 24. The clamping spring 12 can be electrically contacted by means of a test probe through this test opening.

In the embodiment shown in FIG. 1, the terminal face 24 of the cover part 22 extends inclined towards the rear face 5. The guide means 28 are approximately perpendicular to the terminal face 24. The angle of inclination with which the connecting conductor 14 is introduced into the terminal is thus determined by the angle of inclination of the terminal face 24. An embodiment is also conceivable in which the terminal face 24 extends approximately in parallel with the rear face 5 and the guide means 28 are inclined with respect to the terminal face 24. The angle of inclination with which the connecting conductors 14 are inserted into the terminal is then determined by the angle of inclination of the guide means 28 with respect to the terminal face 24.

The cover part 22 can be produced very advantageously as injection moulded part of plastic in one injection process.

Figure 4A:
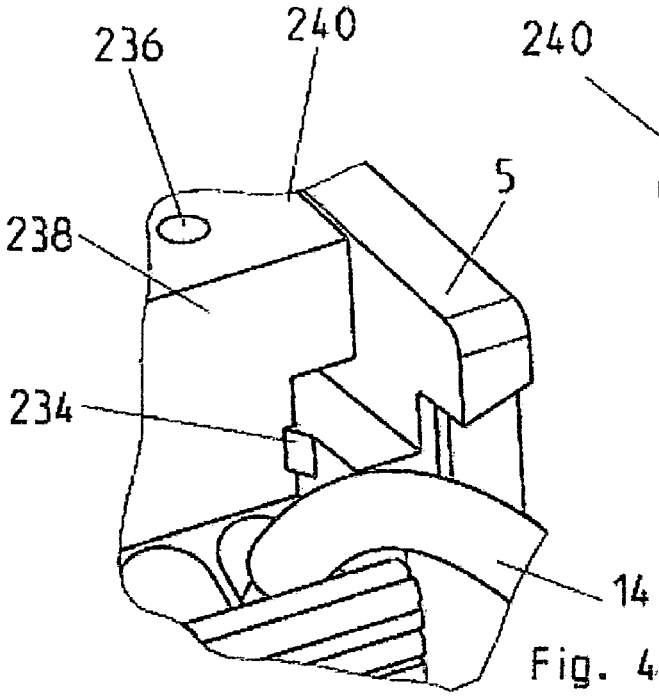
FIG. 4*a*: shows a diagrammatic part-view of an installation switching device according to the invention in a second embodiment.
Figure 4B:
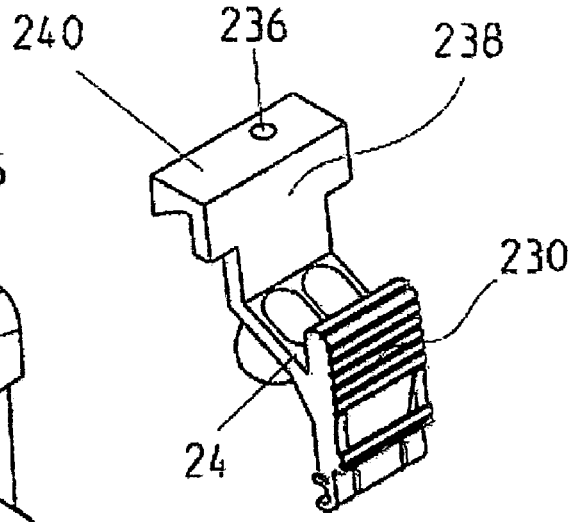
FIG. 4*b*: shows the terminal cover part for use with the installation switching device according to the invention according to FIG. 4*a*, FIG. 5: shows a diagrammatic part-view of an installation switching device according to the invention in a third embodiment.
Figure 5:
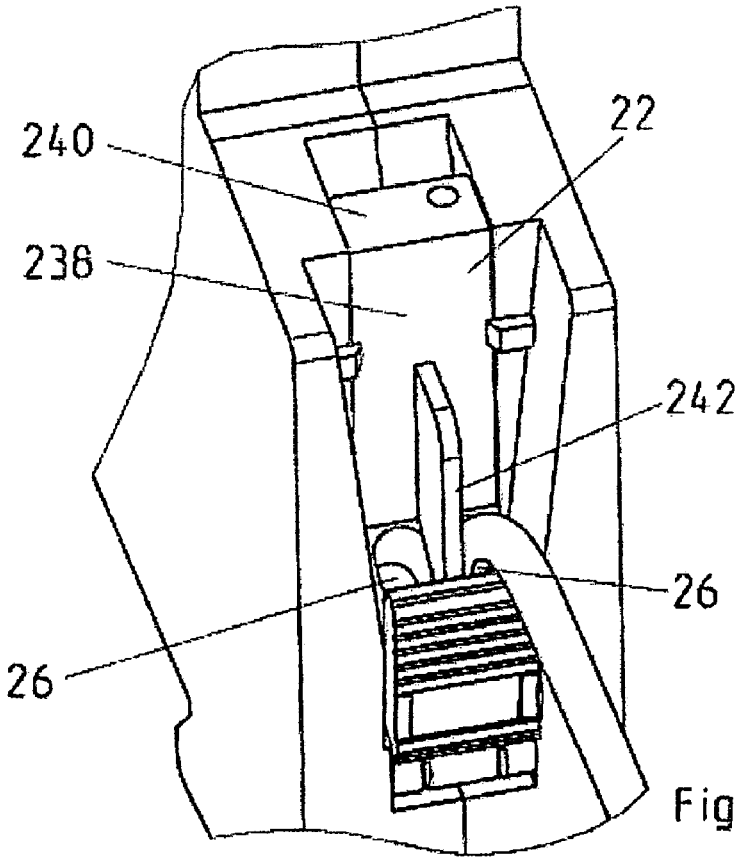

FIGS. 4*a*, 4*b*, 5 show further variants of an installation switching device according to the invention. Only the essential differences with respect to the embodiments explained previously will now be discussed.

In the embodiment according to FIGS. 4*a* and 4*b*, the terminal connection space is placed lower, that is to say arranged further away from the rear face 5 in the direction of the mounting side 6 in the housing 3 of the installation switching device 1. The resultant greater distance of the terminal face 24 from the rear face 5 is compensated for by a spacing area 238 which is moulded onto the cover part 22 following the terminal face 24 as additional part-area. The spacing area 238 carries at its free end a second operating area 240 which is approximately flush with the rear face 5 when the cover part 22 is inserted. In this case, the test opening 236 is arranged in the second operating area 240. Placing the terminal connection space 18 lower brings further operating advantages when inserting the connecting conductors 14. The terminal connection 10 can now also be operated from the front face via the second operating area 240.

Furthermore, the projection 234 used as stop is attached laterally at the wide sides of the housing in the embodiment according to FIGS. 4*a* and 4*b*.

In the embodiment according to FIG. 5, the terminal connection space is placed even lower, that is to say arranged further apart from the rear face 5 in the direction of the mounting side 6 in the housing 3 of the installation switching device 1. The terminal cover part 22 here has a web 242 pointing away perpendicularly from the terminal face, between the two terminal openings 26. The web 242 is also supported on the elongated spacing area 238 of the cover part 22. The web 242 is used for stiffening and thus for increasing the mechanical strength. The cover part 22 can be produced very advantageously as an injection moulded part in one injection process also with the web 242.

Figure 7:
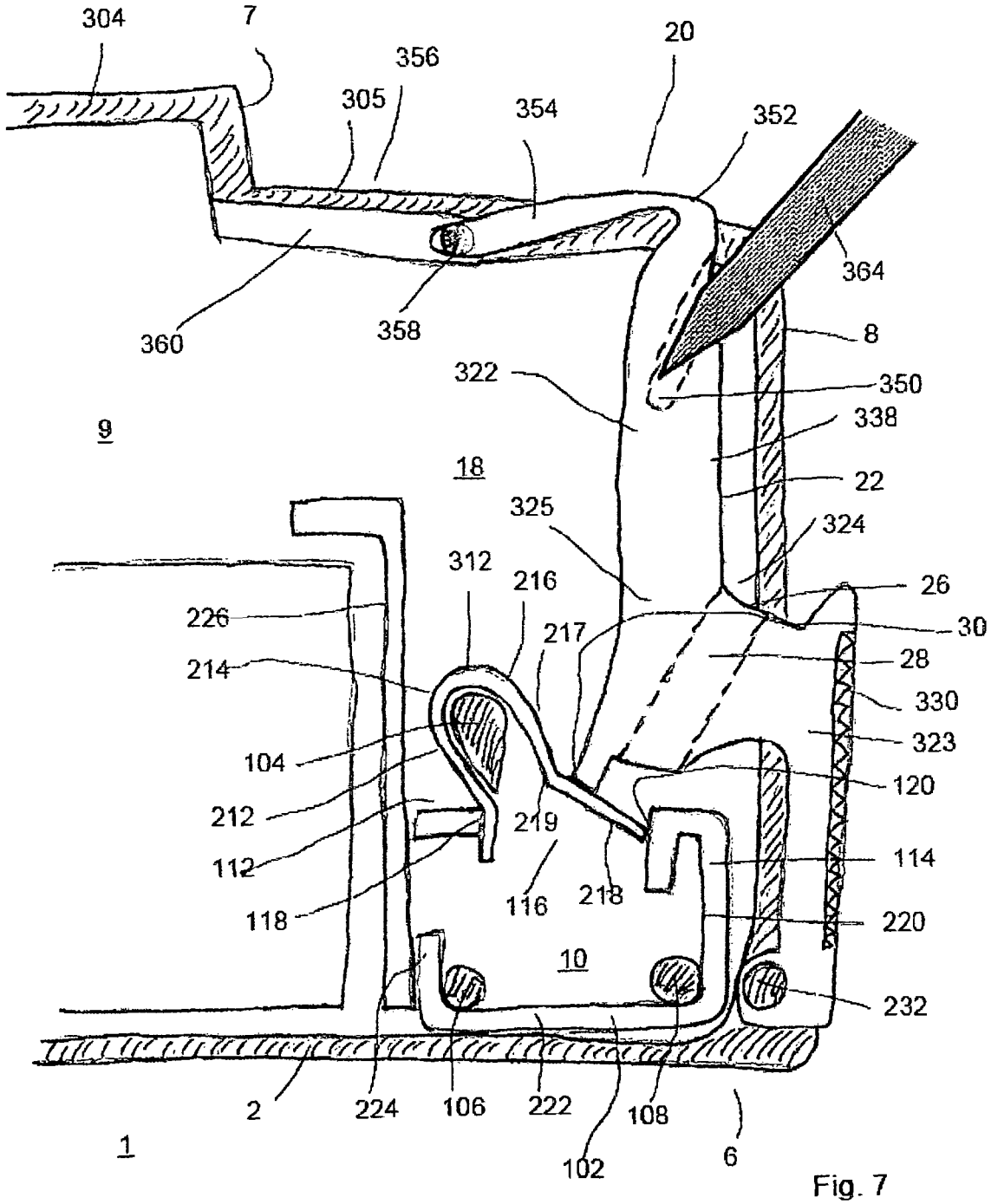

FIG. 7 shows a partial sectional view of the terminal connection space 18 of a further installation switching device 1 according to the invention.

The installation switching device 1 has an insulating housing, formed of two housing parts 2, with a front face 304, a rear face 305, a mounting side 6, a front narrow side 7, a rear narrow side 8 and two wide sides 9, only one of which, located in the plane of the drawing, is shown in the view according to FIG. 1.

The terminal connection space 18 is limited laterally, that is to say towards the wide side, by the housing wide sides 9 of the insulating housing 3.

Towards the front face 304, an opening 20 of the terminal connection space 18 is formed by an opening in the rear face 305 of the housing part 2, through which the terminal connection 10, fixed in position in the terminal connection space 18, is accessible for the connection of connecting conductors 14. The front narrow side 7 is initially adjoined by a part piece 356, at the housing side, of the rear face 305. This produces an opening 20 at the rear face 305 in the area between the end of the part piece 356 at the housing side, facing away from the front narrow side 7, and the rear narrow side 8.

Due to a further opening at the rear narrow side 8 of the housing part 2, the opening 20 of the terminal connection space 18 extends beyond the contact edges between the rear narrow side 8 and the rear face 305 into the rear narrow side 8. This has the advantage that increased flexibility is given for the direction of connection of the connecting conductor 14.

The terminal connection 10 described in the text which follows essentially corresponds to the terminal connection already described above in FIGS. 1-6. It comprises a conductor bar 102 and a clamping spring 312. The terminal connection 10 is fixed in position in the terminal connection space 18, in a manner known per se, on the inside of the wide side 9 by means of webs 104 and pins 106, 108. The terminal connection 10, fixed in position in the terminal connection space 18, is located between the rear narrow side 8 and the rear mounting side 6 in the area of the contact edge.

The conductor bar 102 of the terminal connection 10 comprises a connecting end 112 and an adjoining discharge area 114. At the connecting end 112, it has a window-like opening 116 with a support edge 118 and a clamping edge 120 opposite the support edge 118. The clamping edge 120 is located at the transition of the connecting end 112 into the discharge area 114.

The clamping spring 12 has a support leg 212 with which it is supported on the support edge 118 of the conductor bar 102. It can be supported in such a manner that the support leg 212 has at its free end an upward bend with which it partially encloses the support edge 118 for the purpose of supporting it.

The support leg 212 is adjoined by an arc piece 214 which is adjoined by a clamping leg 216. The conductor end of a connecting conductor (not shown here) is inserted into the window-like opening 116 from the side of the arc piece 214 and can be clamped tight between the clamping leg 216 and the clamping edge 120, acting as abutment. The free end of the clamping leg 216 passes through the window-like opening 116.

The conductor bar 102 approximately has a U-shaped basic form, the connecting end 112 forming the first U-leg and the discharge area 114 being formed by a crossbar 220 and the second U-leg 222. At the free end of the second U-leg 222, an upward bend 224 is attached. At this upward bend 224, further connecting conductors can be attached by means of which the terminal connection 10 is connected to other assemblies within the switching device housing such as, for example, the tripping assemblies. In particular, the connecting conductors can be welded on or hard-soldered onto this upward bend and screwing-on is also possible.

In the embodiment of a terminal connection which is shown in FIG. 1, the upward bend is elongated to form a discharge bar 226 at the free end of the second U-leg 222. The discharge bar 226 is thus positively connected with the second U-leg 222; it points approximately perpendicularly from the latter in the direction of the window-like opening 116 and projects over the latter.

In this embodiment, the arc piece 214 is first adjoined by a first part-clamping leg 27 which changes into a second part-clamping leg 218, bent away from the first part-clamping leg 217, at a bending edge 219 so that the first and the second part-clamping leg 217, 218 assume an obtuse angle with respect to one another. The opening of the obtuse angle points into the direction of insertion of the connecting conductor, the bending edge 219 is located approximately in the centre of the clamping leg 216.

The opening 20 of the terminal connection space 18 is covered by a terminal cover part 22 swivelably connected with the housing part 2.

The terminal cover part 22 comprises a first part-body 322, longitudinally extended in the direction of the rear narrow side 8 and coupled swivelably to the housing part 2 via a hinge pin 232, and a closing part 354 swivelably coupled to its free end via a hinge 352 which extends approximately in parallel with the rear face 305. To improve the mobility in the hinge 352, it is constructed as film hinge.

The first part-body 322 comprises a first cover plate 323 which covers the terminal connection space 18 in the lower part, adjoining the mounting side 6, of the narrow side 8 and which carries an approximately tube-like counterpiece to the hinge pin 232 with which it is coupled swivelably at the hinge pin. The first cover plate 323 has a pressure area 330 which is accessible from the outside and can be operated manually.

In the vicinity of the free end of the pressure area 330, the first cover plate 323 is connected via an intermediate piece 325, pointing into the interior of the housing, with a spacing area 338 which also extends in parallel with the rear narrow side 8 in the direction of the face 305 and covers the terminal connection space 18 in the upper part of the narrow side 8, adjoining the rear face 305.

At the free end of the spacing area 338, the aforementioned film hinge 352 with the closing part 354, coupled swivelably thereto, is located.

This is a plate which, at its free end, overlaps at least partially the part 356 at the housing side of the rear face 305. The closing part 354 and the part 356 at the housing side of the rear face thus together form the rear face 305.

At its free end, the closing part 354 carries pins 358 protruding laterally, pointing in the direction of the wide sides 9. In the housing, a rocker-like guide 360 is attached close to the part 356 at the housing side, of the rear face 305, in such a manner that the pins 358 are accommodated in the guide 360.

If then the terminal cover part 22 is swivelled in the direction of the interior of the device by pressure on the pressure area 330, the closing part 354 will slide behind the part 356 at the housing side, of the rear face 305, and is guided by the rocker-like guide 360 displaceably in parallel with the latter. During this process, the angle changes between the closing part 354 and the spacing area 338.

Thus, the closing part 354 and the spacing area 338, in the closed position according to FIG. 7, form an acute angle with one another which is open towards the interior of the housing. In the position according to FIG. 2, the closing part 354 and the spacing area 338 form an obtuse angle with an opening into the interior of the housing when the terminal cover part 22 is swivelled into the interior of the housing.

On actuation of the terminal cover part and the associated swivelling about the hinge pin 232, the closing part 354 and the spacing area 338 also perform a swivelling movement with respect to one another around the film hinge 352.

By attaching the film hinge between the closing part 354 and the spacing area 338, the closing part 354 can thus shift approximately parallel behind the part 356 at the housing side, of the rear face 305, in a space-saving manner The intermediate piece 325 has a terminal face 324 pointing towards the outside. There is at least one terminal opening 26 in the terminal face 324. Starting from the terminal opening 26, a tube-like opening 28 passes through the intermediate piece 325, which penetrates the intermediate piece 325 approximately perpendicularly starting from the terminal face 324 and is thus used as guide means for a connecting conductor to be connected to the terminal connection 10.

The connecting conductor is guided through the terminal opening 26 in the terminal cover part 22 and, after leaving the tube-like opening 28, encounters the clamping leg 216 of the clamping spring 312.

If the connecting conductor is a rigid conductor, the clamping leg 216 of the clamping spring 312 can be pressed away from the clamping edge 120, by means of the connecting conductor alone, to such an extent that the connecting conductor can be inserted and clamped tight in the window-like opening 116 between the free end of the clamping leg 216 and the clamping edge 120.

In the case of a flexible connecting conductor, the window-like opening 116 must first be opened in another way.

This is done by swivelling the terminal cover part 22.

In the vicinity of the tube-like opening 28, the terminal cover part 22 carries at the intermediate piece 325 a nose 30, pointing towards the clamping leg 216, which is used as spring actuating means.

Naturally, the nose 30 can also be other protruding components, in particular, the function of the nose 30 could also be formed by a web surrounding the exit opening of a tube-like opening 28 in the manner of a collar.

Due to the restoring spring force of the clamping leg 216, the latter presses the nose 30, and thus the terminal cover part 22, towards the outside.

Figure 8:
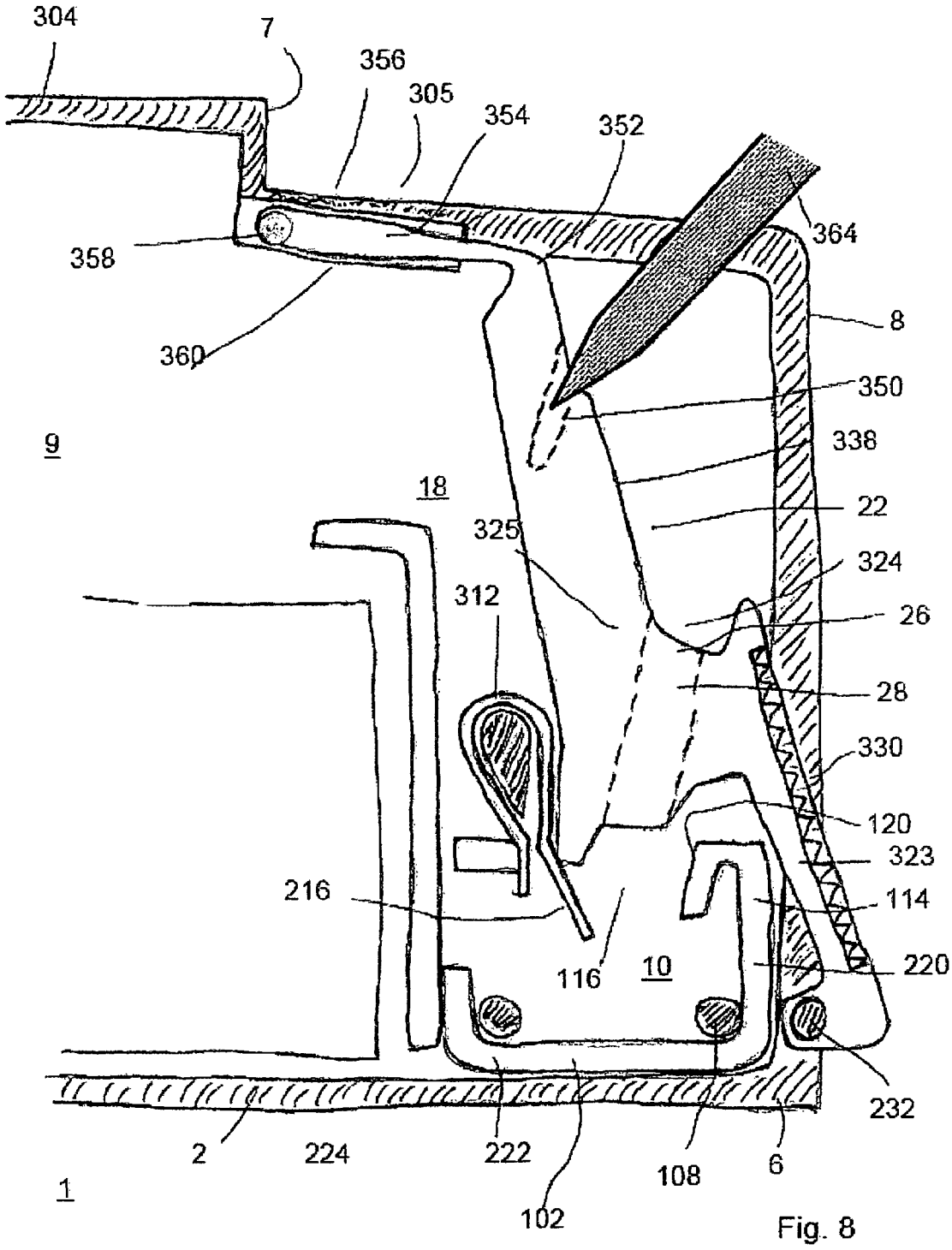
FIG. 8: shows a diagrammatic part-view of the installation switching device according to FIG. 7, with the terminal opened in the operated position.

The terminal cover part 22 is swivelled inwards by pressure on the pressure area 330 or on the spacing area 338, and the clamping leg 216 is pressed away from the clamping edge 120 via the nose 30 to such an extent that the window-like opening 116 becomes free for inserting the connecting conductor, see FIG. 8.

The nose 30 is moulded onto the terminal cover part 22 and constructed in such a manner that, when the cover part is swivelled against the clamping spring, it loads it to open close to the bending edge 219.

Due to its alignment in such a manner that it loads the clamping spring to open close to the bending edges when the cover part is swivelled, less force expenditure is required during the opening actuation of the terminal cover part, the opening area in the clamping window remaining of the same size.

In an actual example, the first and second part-clamping leg 217, 218 form an angle of approximately 160°. With respect to a clamping spring with straight unbent clamping leg 216, otherwise unchanged, the introduction of the angle halves the actuating force with maximum terminal aperture.

A corresponding procedure is adopted for detaching a connecting conductor clamped on. Pressure on the terminal cover part 22 detaches the clamping between the clamping leg 216 and the connecting conductor in the manner described above so that the latter can be pulled out of the window-like opening 116. Due to the kinked construction of the clamping leg 216, described above, the actuating force for detaching the connecting conductor is also much lower.

A corresponding procedure is adopted for detaching a connecting conductor clamped on. Pressure on the terminal cover part 22 loosens the clamping between the clamping leg 216 and the connecting conductor in the manner described above, so that the latter can be pulled out of the window-like opening 116.

As an alternative, the opening movement of the terminal cover part 22 can also be effected by a commercially available longitudinal-slot or crossed-slot screwdriver 364. For this purpose, the latter is placed into a receiving opening 350, suitable for reception (slot-, cross-shaped or spherical recess) at the spacing area 338 at an acute angle and the terminal is opened by a pressure movement with the screwdriver 364.

Even if only one terminal opening 26 and only one tube-like opening 28 are shown in the representation according to FIGS. 7 and 8, two or more such terminal openings and recesses can naturally also be provided for receiving and connecting a number of connecting conductors in the intermediate piece 325. All connected connecting conductors can be clamped on with a common clamping spring via its clamping legs 216. When the terminal cover part 22 is actuated, all connected conductors are then released simultaneously and can be detached simultaneously.

In a further embodiment, to which, however, the same FIGS. 7 and 8 apply as diagrammatic drawings, the terminal cover part 22 with the first part-body 322, the hinge 352 and the closing part 354 consists of two material components having different mechanical properties.

These are joined to one another in a two-component injection moulding process.

The result is a hard/soft compound. The hard component forms the major component. The first part-body 322 is produced from this. It is used for transferring the actuating forces to the clamping spring 312 and during this process preventing or at least minimizing a bending-through of the component.

The soft component is used in the area of the hinge 352 and of the closing part 354.

This provides for easy mobility of the hinge which is required so that the angular change of the angle between the closing part 354 and the first part-body 322 on actuation of the terminal cover part 22 as described above can be easily adjusted.

In this embodiment, the hinge 352 does not necessarily have to be a film hinge. This is because the mobility of the hinge is ensured by the choice of a flexible material in the hinge area and not by the thickness of the hinge alone.

Flexibility of the closing part 354 also contributes to the latter being able to bend to some extent when it is displaced in parallel with the rear face 305 towards the front narrow side 7 in the rocker-like guide 360, and can thus rest against the front narrow side 305 even more easily and narrowly.

Overall, this leads to a very close guidance of the closing part 354 at the rear face 305, and thus to great space saving during the swivelling of the terminal cover part 322.

LIST OF REFERENCE DESIGNATIONS

1 Installation switching device
2 Housing part, housing
3 Housing
2*a* Partition line
4 Front face
5 Rear face
6 Mounting side
7 Front narrow side
8 Rear narrow side
9 Wide side
10 Screwless terminal connection
12 Clamping spring
13*a, b* Part-spring
14 Connecting conductor
16 Stripped connecting conductor end
18 Terminal connection space
20 Terminal connection space opening
22 Cover part, terminal cover part
24 Terminal face
26 Terminal opening
28 Guide means, tube-like opening
30 Spring actuating means, nose
102 Conductor bar
104 Web
106 Pin
108 Pin
110 Projection
112 Connecting end
114 Discharge area
116 Window-like opening
118 Support edge
120 Clamping edge
212 Support leg
214 Arc piece
216 Clamping leg
217 First part-clamping leg
218 Second part-clamping leg
219 Bending edge
220 Crossbar
222 Second U-leg
224 Upward bend
226 Discharge bar
228 Upward bend
230 Pressure area
232 Hinge pin
234 Projection
236 Test opening
238 Spacing area
240 Second operating area
242 Insulating web
304 Front face
305 Rear face
312 Clamping spring
322 First part-body
323 First cover plate
324 Terminal face
325 Intermediate piece
330 Pressure area
338 Spacing area
350 Access opening
352 Hinge
354 Closing part
356 Part at the housing side, of the rear face
358 Pin
360 Rocker-like guide in the inner wide side
364 Screwdriver
2181 Slot

The invention claimed is:

1. An installation switching device comprising:

a housing having a front, and a rear face, a mounting side, at least one front and rear narrow side, two wide sides and a terminal connection space laterally limited by the two wide sides and having an opening at least on the rear face;

a screwless terminal connection including a clamping spring disposed in a terminal connection space and configured to connect a plurality of connecting conductors, and a terminal cover part swivelably connected to the housing and configured to cover the opening, the terminal cover part having a terminal face with a plurality of terminal openings, each corresponding to one of the plurality of connecting conductors to be connected and a guide device molded onto each of the at least one terminal openings and configured to guide the connecting conductors; and a spring actuating device molded onto the terminal cover part and arranged so as to load the clamping spring in an opening manner when the terminal cover part is swiveled against the clamping spring.

2. The installation switching device as recited in claim 1, wherein the installation switching device includes at least one of a circuit breaker, a fault-current circuit breaker, and a motor protection switch.

3. The installation switching device as recited in claim 1, wherein the guide device includes a tube-like hollow body forming a lead-in conduit also used as a spring actuating device for the clamping spring.

4. The installation switching device as recited in claim 1, wherein the housing includes a projection, wherein the terminal cover part can be pressed against the clamping spring and is resiliently loaded by the clamping spring against the projection opposing the direction of insertion of the connecting conductor.

5. The installation switching device as recited in claim 1, further comprising a closing part coupled swivelably with a free end of a first part-body of the terminal cover part covering the terminal connection space at the rear face in collaboration with a housing-fixed rear face end, the closing part at least partially overlapping the housing-fixed rear face end on actuation of the terminal cover part.

6. The installation switching device as recited in claim 5, further comprising a hinge coupling the closing part to the terminal cover part.

7. The installation switching device as recited in claim 5, further comprising a housing-fixed rocker-like guide and laterally protruding guide pins, wherein the closing part is guided displaceably in the rocker-like guide in parallel with the front face via the guide pins.

8. The installation switching device as recited in claim 5, wherein the terminal cover part, following a terminal face, includes a spacing area forming a closure at the terminal cover part side of the terminal connection space in an area of the rear narrow side, wherein the closing part is coupled swivelably so as to form a coupling at an end of the spacing area pointing towards the front face.

9. The installation switching device as recited in claim 5, wherein the closing part includes a material having different mechanical properties than the first part-body.

10. The installation switching device as recited in claim 6, wherein the hinge and the closing part, in an area of the hinge, are comprised of a material having different mechanical properties than the first part-body.

11. The installation switching device as recited in claim 8, wherein the spacing area is configured to be rigid and the closing part is configured to be more flexible than the spacing area.

12. The installation switching device as recited in claim 1, wherein the clamping spring acts as a compression spring on a conductor end and clamps the conductor end at an abutment, and wherein the screwless terminal connection includes a conductor bar having a connecting end, an adjoining discharge, area, a window-like opening with a support edge at the connecting end, and a clamping edge opposite the support edge at a transition of the connecting end into the discharge area, and wherein a support leg supports the clamping spring at the support edge of the conductor bar, and wherein an arc piece adjoins the support leg and is adjoined by a clamping leg so as to clamp the conductor end between the clamping leg and the clamping edge.

13. The installation switching device, as recited in claim 12, wherein the arc piece is adjoined by a first, part-clamping leg changing into a second-part clamping leg bent away from the first-part clamping leg at a bending edge so as to form an obtuse angle between the first- and the second-part clamping leg opening in a direction of insertion of the connecting conductor.

14. The installation switching device as recited in claim 13, wherein the conductor bar approximates a U-shape, the connecting end forming one U-leg and the discharge area formed by a crossbar and a second U-leg.

15. The installation switching device as recited in claim 14, wherein a discharge bar extends approximately perpendicularly to the second U-leg and is disposed onto a free end of the second U-leg, and wherein the discharge bar supports a side of the connecting end opposite the clamping edge.

* * * * *